US006991592B2

(12) United States Patent
Wold et al.

(10) Patent No.: US 6,991,592 B2
(45) Date of Patent: Jan. 31, 2006

(54) METHOD OF FOLDING FLAT BOTTOM BAG

(75) Inventors: James Trygve Wold, Long Beach, NY (US); Edward Stanley Madej, Morris Plains, NJ (US)

(73) Assignee: Genpak LLC, Glen Falls, NY (US)

( * ) Notice: Subject to any disclaimer, the term of this patent is extended or adjusted under 35 U.S.C. 154(b) by 0 days.

(21) Appl. No.: 10/772,554

(22) Filed: Feb. 5, 2004

(65) Prior Publication Data

US 2005/0176569 A1 Aug. 11, 2005

(51) Int. Cl.
*B31B 1/90* (2006.01)

(52) U.S. Cl. ..... 493/218; 493/255; 493/261; 493/310

(58) Field of Classification Search ..... 493/218, 493/219, 310, 311, 255, 261; 383/8, 127
See application file for complete search history.

(56) References Cited

U.S. PATENT DOCUMENTS

| | | | | | |
|---|---|---|---|---|---|
| 542,447 | A | * | 7/1895 | Pettee | 493/255 |
| 2,231,051 | A | | 2/1941 | Bischoff | |
| 2,324,358 | A | | 7/1943 | Burroughs | |
| 2,648,263 | A | * | 8/1953 | Richens | 493/205 |
| 2,771,010 | A | | 11/1956 | Piazze | |
| 2,773,435 | A | | 12/1956 | Richens | |
| 3,237,534 | A | * | 3/1966 | Lissner | 493/189 |
| 3,266,387 | A | * | 8/1966 | Finke et al. | 493/190 |
| 3,599,539 | A | * | 8/1971 | Coverstone et al. | 493/189 |
| 3,690,221 | A | | 9/1972 | Schmedding | |
| 3,766,710 | A | * | 10/1973 | Goodwin et al. | 53/373.6 |
| 3,853,040 | A | * | 12/1974 | Achelpohl | 493/194 |
| 3,896,709 | A | | 7/1975 | Brinkmeier | |
| 4,183,515 | A | * | 1/1980 | Coast | 493/444 |
| 4,184,627 | A | | 1/1980 | Achelpohl et al. | |
| 4,546,592 | A | * | 10/1985 | Reil | 53/373.6 |
| 5,102,384 | A | * | 4/1992 | Ross et al. | 493/243 |
| 5,165,799 | A | * | 11/1992 | Wood | 383/8 |
| 5,549,538 | A | | 8/1996 | Marsik | |
| 5,644,900 | A | * | 7/1997 | Steele et al. | 53/449 |
| 5,913,764 | A | * | 6/1999 | Kolbe et al. | 493/218 |
| 6,042,526 | A | | 3/2000 | Baumer | |
| 6,206,570 | B1 | * | 3/2001 | Cortopassi | 383/127 |
| 6,328,683 | B1 | * | 12/2001 | Rautenberg | 493/255 |

FOREIGN PATENT DOCUMENTS

| | | |
|---|---|---|
| JP | 54-116122 | 8/1979 |
| JP | 2002-36394 | 2/2002 |
| JP | 2003-33981 | 2/2003 |

* cited by examiner

*Primary Examiner*—Stephen F. Gerrity
*Assistant Examiner*—Hemant M. Desai
(74) *Attorney, Agent, or Firm*—Merchant & Gould P.C.

(57) ABSTRACT

A method for folding a polymeric flat bottom bag. The process includes, in general, opening the partially folded bottom of the unfinished bag, pulling the bag bottom taught in the transverse direction, and forming a fin where the two material edges join. A sharp crease is formed between the fin and the base portions of the bag bottom, and the fin is sealed. The fin is creased and sealed while the bag is moving in its transverse direction. The bag's direction is changed, so that the bag is moving in its longitudinal direction, and the fin flaps then folded against the base of the bag bottom. The flaps are sealed to the bottom, resulting in a flat bottom bag. A label may be added to the bottom of the bag.

16 Claims, 7 Drawing Sheets

FIG. 1
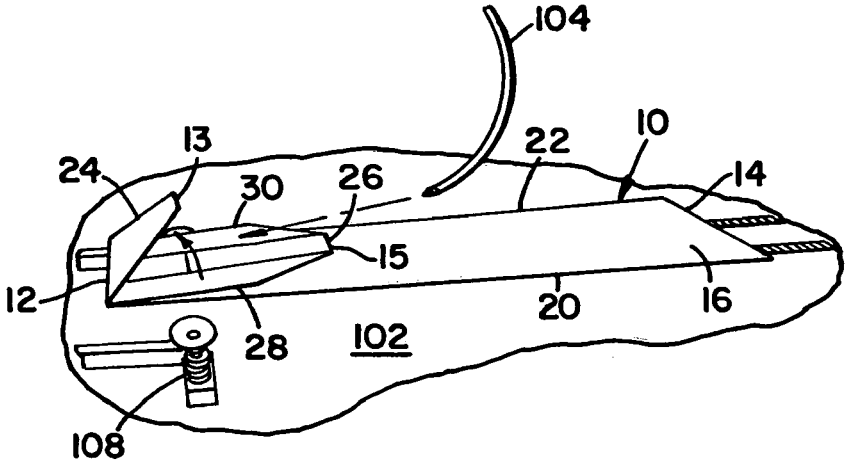
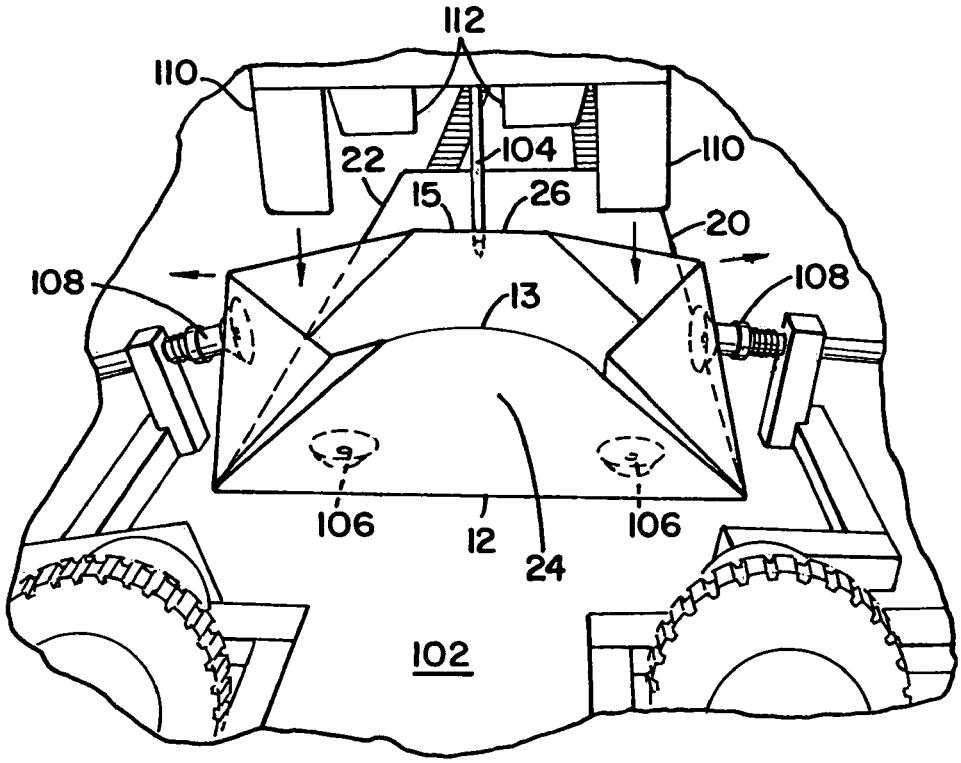
FIG. 2

METHOD OF FOLDING FLAT BOTTOM BAG

FIELD OF THE INVENTION

The present invention relates to methods of making packages. In particular, the invention relates to methods of folding leak resistant, flat bottom bags.

BACKGROUND

Bags are a common form of packaging and are readily available. Bags are generally flexible; they easily conform to the shape of the item being retained; and they are relatively inexpensive to produce. Over the years, methods for making flat bottom bags have changed, from manually folding paper sheets to form the bags, to mechanical processes for automatically folding paper sheets to form the bags.

A common bag configuration is a flat bottom bag with gusseted sides. Both the standard, brown paper grocery bag and brown paper lunch bag are such flat bottom bags. A standard flat bottom bag is illustrated in FIG. 13, showing the various flaps and folds. Such a configuration, in addition to the paper material, is not resistant to water or other liquid, due to the bottom fold configuration. Indeed, such a construction easily allows passage of liquid therethrough.

Other bottom fold configurations for flat bottom bags are known.

One method for folding paper flat bottom bags (also referred to as block-shaped bottom bags) having a fold configuration different than the grocery bag, discussed above, is described in U.S. Pat. No. 3,266,387, Finke et al. The bag produced by Finke et al. is illustrated in FIG. 14, showing the various flaps and folds, The process of Finke et al. begins tubular bags (i.e., unfinished bags having a non-sealed bottom). The teachings of Finke et al. include folding the bottom, changing the bag orientation direction, and then raising the corner pleats.

Improvements are desirable.

SUMMARY OF THE INVENTION

The present invention is directed to a method for folding a bottom for a flat bottom, non-paper bag. The process is an automated, robotic system that eliminates the need for operator interaction in order to fold or otherwise manipulate the bag during the bottom folding process.

The method begins with an unfinished bag, already formed into a general shape having a sleeve defining a longitudinal direction and a transverse direction, the sleeve having a mouth end and a bottom end and defining an interior. At the bottom end is an unfinished base portion. The method of the invention then folds the unfinished bag, by a sequence of steps at a variety of process stations, to provide a completed bag.

In one particular embodiment, the method of the invention is directed to folding a bag, including opening an unfinished base portion of an unfinished flat bottom bag and extending the gussets transversely, forming a fin extending transversely across the unfinished base portion, and then folding a first end and a second end of the fin against the unfinished base portion to form a base. Using such a method, at least 20 bags/minute can be folded. In some embodiments, at least 40 bags/minute can be folded.

BRIEF DESCRIPTION OF THE DRAWINGS

FIG. 1 is a perspective side view of a first step in the method of the present invention, with the package blank at a first process location.

FIG. 2 is a perspective end view of a second step in the method of the present invention, with the package blank in a first position, at the first process station.

DETAILED DESCRIPTION

Figure 3:
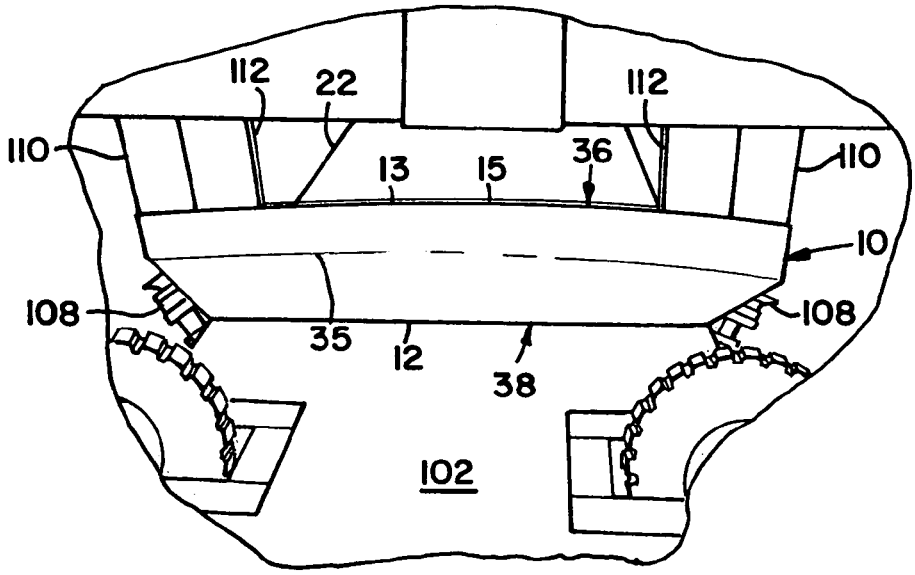
FIG. 3 is a perspective end view of a third step in the method of the present invention, at the first process station, with the package blank in a second position.

Process speed is a factor in whether or not processes are commercially successful. The present invention provides a fast, fully automated process for folding non-paper, flat bottom bags having side gussets. The process includes using modern technology, such as robotics and programmable motion controllers.

The bags folded by the method of the present invention are "non-paper", meaning, that at least the outer surfaces of the bags are not a cellulosic material. The preferred material from which the bag is made is a sheet of polymeric material, such as polyethylene (either high density or low density), polypropylene, polyester, or blends thereof.

The polymeric sheet may be a layered co-extrusion of two or more types of materials. The polymeric sheet may include a base paper or cellulosic layer onto which a polymeric layer is adhered. As another alternative, the polymeric sheet may include a reinforcing or strengthening scrim, paper, or fibers.

The polymeric sheet may have a surface coating on one or both sides of the sheet. Any coating may be applied to the formed polymeric sheet or may be co-extruded with the polymeric sheet. One preferred surface coating is a UV-resistant coating, present on the side of the sheet that will be the outer surface of the bag. A UV coating, in addition to reducing any harmful effect from exposure to UV, increases the gloss of the material and reduces scuffing of any printing on the surface.

Typically, the sheet material has a thickness of about 2 to 10 mil, and is usually about 5 mil thick.

A polymeric bag is preferred over paper or other cellulosic bags, in general, because the polymeric bag is resistant to passage of moisture or liquid therethrough (i.e., is leak resistant), and is tear and puncture resistant.

Unfinished bags, which include a sleeve defining a mouth, a partially folded bottom, and side gussets, are used as the feed material for the folding process of the present invention. Such unfinished bags can be folded by commercially available packaging machines. One example of a machine that provides an unfinished bag is a W&H Triumph bag machine, which is available from Windmoeller & Hoelscher Corp. Other examples of machines that provide such an unfinished bag are available from H. G. Weber & Co., Inc., and Fisher & Krecke.

The process includes, in general, opening the partially folded bottom of the unfinished bag, first by lifting an end flap to provide sufficient room for a bottom opening mechanism to fit within the various bottom flaps. Once situated, the bottom opening mechanism pulls the bag bottom taught in the transverse direction, forming a fin where the two edges of the bag material join. A sharp crease is formed defining the fin between the base portions of the bag bottom, and the two edges f the bag material are seamed, to seal the fin. The fin is creased and sealed while the bag is moving in its transverse direction. After the fin is sealed, the direction of bag movement is changed. While the bag is moving in its longitudinal direction, the fin ends, or flaps, are folded against the base of the bag bottom. The flaps are sealed to the bottom, resulting in a flat bottom bag. A label may be added to the bottom of the bag.

In a more detailed description of the process of this invention, the process includes, in general, supplying partially folded bags to the process machine from a typical flat-bottom bag forming machine, with the bottom unsealed. These bags are loaded into a holder, such as a magazine.

From the holder, the partially folded bags are transported to a first station and stopped so that the centerline of the unsealed bottom is aligned with a mechanism to open the folded, but unsealed bottom. The bag is oriented so that during transport, the leading edge is the unsealed bottom and the trailing edge is the mouth of the bag. While stationary, the unsealed bottom is opened, or "reformed", in such a manner that the original fold lines are used to maintain the flat bottom configuration while forming a sealable profile. A seal area is defined by the overlap material used in a conventional flat bottom forming operation. In accordance with the process of the present invention, two steps can be used to define the seal area.

In the first step, the bottom is opened enough to allow a bottom opening mechanism, such as a set of finger mechanisms, to drop into the open bottom and transversely stretch the bottom. In the stretched form, the two edges of the package material meet, forming a fin across the bottom of the unfinished bag.

The bag, with the finger mechanisms still positioned inside, is transported to a sealing area. At a first location in the sealing area, the bag bottom passes through a station that provides further definition between the fin and the bag bottom. This first location or station flattens the bottom and forms a semi-sharp crease between the bottom and the fin. A second portion of this station forms a sharper crease between the bottom and the fin. This defining of the fin is accomplished using various plates, press rolls and creasing blades.

Once the fin is sharply creased, the bag progresses to a continuous motion sealer, which seals the two fin layers together by the application of heat and pressure. A rotary band sealer is a preferred sealer for this operation. While the seal is warm, the fin is deflected down toward the bottom to facilitate subsequent folding.

Exiting from the sealing area, the bag changes its travel direction and is brought to a folding station. The folding station has guides, which fold the fin end flaps back onto the bag bottom. As the flaps are folded in, an adhesive is applied to hold the flaps in position against the bottom. Pressure is applied to iron the flaps against the bottom, and a finished bag is produced.

A label may be positioned over the bottom to provide a more refined look to the bottom.

Using the process of the invention, described in detail below, bags can be completed at a rate of at least 20–25 bags/minutes per process line. Depending on the polymeric sheet material used for the bags, 40–60 bags/minutes can be folded; such a rate can be obtained when a 5 mil thick high density polyethylene material is used.

The finished bag typically has a length, from its mouth to the bag bottom, of about 12–30 inches, and a width of about 6–18 inches, although the process equipment could be scaled to accommodate virtually any size bag. Bags as small as 3 inches wide and 6 inches tall, which are often used for packaging coffee, can also be made by this process. For a bag 6–14 inches wide, the side gussets are typically about 3–6 inches deep (per side), however, gusset depths of 2–9.5 inches are also common.

The finished bag can be used to hold any type of item, but it typically used for granular items. Because of the polymeric material, the bag is particularly suited for items that are often stored outside in the elements or in locations where the bag could get wet, such as in a garage or storage shed. Examples of items for which the bag is particularly suited include dog food, cat food and other palletized animal food, bird seed, cat litter and other bedding, sorbent materials, and fertilizer.

After the bag is folded and filled, the mouth is typically sealed. The seal may be made with adhesive, stitching, staples or other mechanical fasteners, or merely by melting the bag material together. For some products, a reclosable zipper closure may be added to the mouth of the bag. Such a zipper closure may be present on the unfinished bag, so that the bag progresses through the bottom folding process with the zipper already present at the mouth end, or, the zipper closure may be added to the bag after folding the bottom.

A specific example of a process according to the present invention is described in detail, below, with reference to the drawings, wherein like reference numerals represent like parts and assemblies throughout the several views.

Referring to FIG. 1, a partially folded bag 10 is illustrated. Partially folded bag 10 has a first, bottom end 12 and an opposite second end 14. In the completed package, opposite end 14 will be the mouth or top of the package, through which items are placed and removed from the package. Throughout this discussion, the direction between bottom end 12 and mouth end 14 is referred to as the longitudinal direction. Extending between ends 12, 14 is a front face 16 and an opposite, back face (not illustrated). Partially folded bag 10 also has a first side edge 20 and an opposite second side edge 22. Although not visible in FIG. 1, first side edge 20 is defined by a first sidewall, and second side edge 22 is defined by a second sidewall. Each of the sidewalls includes inwardly folded, expandable, longitudinal gussets extending from end 12 to end 14. Throughout this discussion, the direction across face 16, from side edge 20 to side edge 22, is referred to as the transverse direction.

At the point in the process illustrated in FIG. 1, partially folded bag 10 is preformed with the front and back faces and sidewalls formed. The top of the bag, at second end 14, is in its final configuration, configured for use as a mouth of the final package. First end 12 is partially folded and is considered "unfinished". In this unfinished state, first end 12 has a first flap 24 which has a first bottom edge 13, a second flap 26 which has a second bottom edge 15, a first edge flap 28 on first side edge 20 and a second edge flap 30 on second side edge 22. Such a partially folded bag 10 as illustrated in FIG. 1 can be produced, for example, on a W&H Triumph bag machine, which is available from Windmoeller & Hoelscher Corp. Such bag folding machines are common in the packaging industry.

Once folded, partially folded bag 10 is fed to a first station of the current process, for example by a conveyor belt; such a first station is illustrated in FIG. 1, where partially folded bag 10 is positioned on support surface 102, on its back face. Partially folded bag 10 may be secured to surface 102, for example, by a holding mechanism, such as a vacuum or suction cups. While secured to surface 102, partially folded bag 10 is positioned evenly between a bottom opening and holding mechanism, such as two suction cups 108, one on each side of partially folded bag 10. Partially folded bag 10 is also positioned so that a lifting source, such as a stream of air from air nozzle 104, raises flap 24 up from the rest of partially folded bag 10, in particular, from second flap 26. The stream or jet of air from nozzle 104 is sufficient to raise flap 26.

Referring now to FIG. 2, partially folded bag 10, with flap 24 raised, is gripped by suctions cups 108 on edge flaps 28, 30 while being maintained on surface 102 by a retaining mechanism, such as by suction cups 106. Suction cups 108 pull edge flaps 28, 30 out from the center of partially folded bag 10, thus inverting the side gussets of partially folded bag 10. At this stage, partially folded bag 10 has an opened bottom.

The bottom of partially folded bag 10 is opened in such a manner to allow an extending mechanism, such as fingers 110, sufficient room to slide within partially folded bag 10 between edge 13 of flap 24 and edge 15 of flap 26. In FIG. 2, outer fingers 110 and inner fingers 112 are illustrated progressing into the opened partially folded bag 10.

Once within opened partially folded bag 10, fingers 110, 112 stretch partially folded bag 10 and pull partially folded bag 10 taught across its width, as illustrated in FIG. 3; in particular, fingers 110, 112 pull edge flaps 28, 30 apart. Bottom end 12 of partially folded bag 10 is reformed by this transverse stretching process. During this process, suction cups 108 retract, allowing partially folded bag 10 to tightly stretch, so that flap edge 13 and flap edge 15 are brought together forming a fin 36 extending from a base 38. It is preferred that suction cups 108 release and retract prior to fingers 110, 112 stretching partially folded bag 10. Fingers 110, 112 extend into fin 36 and terminate approximately at fold line 35, which is due to the tension from fingers 110, 112 on edge flaps 28, 30. This fold line 35 is a soft fold line, meaning, that fold line 35 is not a sharp crease having a definite line of demarcation, but rather, has an indefinite crease.

Figure 4:
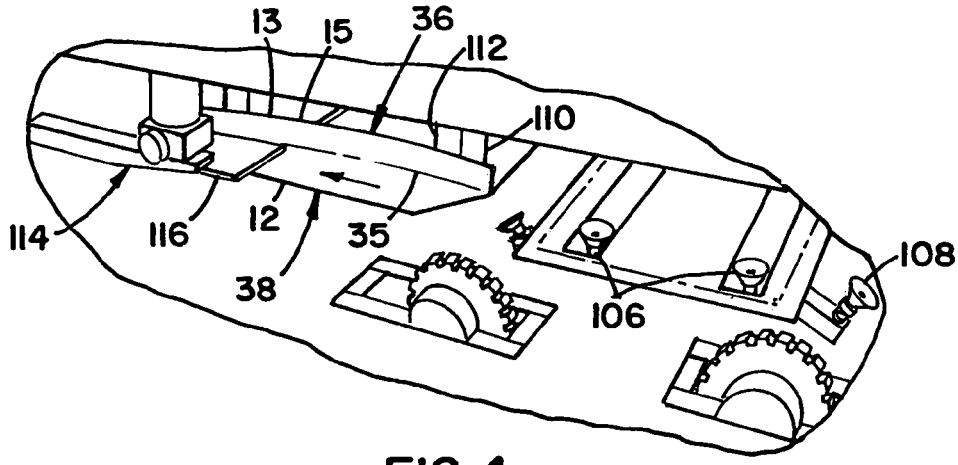
FIG. 4 is a perspective end view of a fourth step in the method of the present invention, with the package blank in a third position, at a first portion of a second process station.
Figure 5:
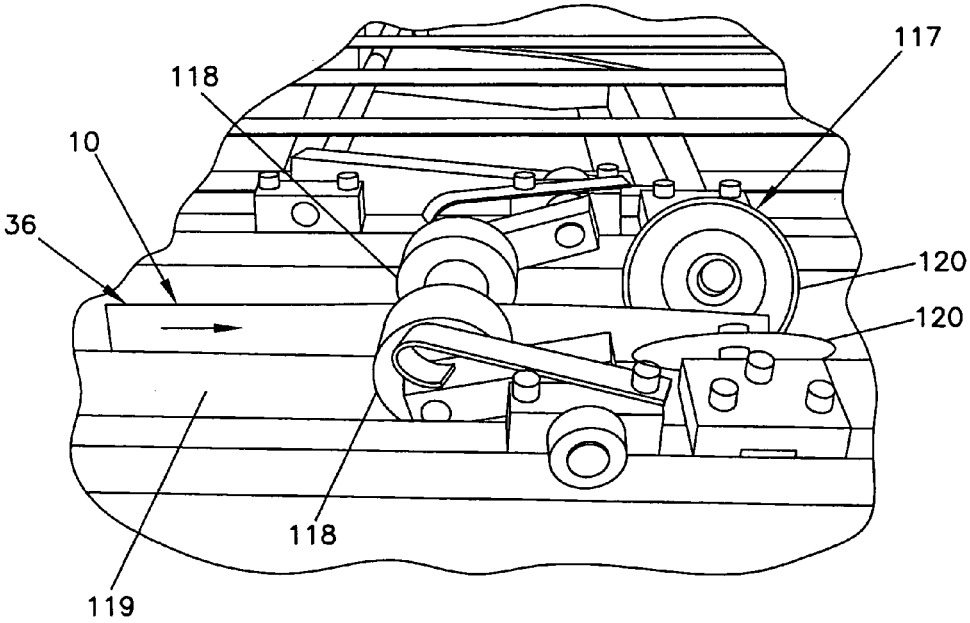
FIG. 5 is a perspective side view of the fourth step, at a second portion of the second process station.

Partially folded bag 10, with reformed bottom end 12, is conveyed, for example, by a carriage assembly, to a second station that includes a creasing mechanism, as shown in FIGS. 4 and 5. Prior to entering creaser mechanism 114, partially folded bag 10 includes soft fold line 35; after being acted on by creaser mechanism 114, partially folded bag 10 has a sharp, distinct fold line 35.

Referring to FIG. 4, partially folded bag 10 is illustrated moving transversely from right to left of the drawing into a first portion of a creaser mechanism 114, with fingers 110, 112 retained in place within fin 36. Creaser mechanism 114 includes a foot 116 which rests on and applies pressure to base 38 of partially folded bag 10. As partially folded bag 10 moves under foot 116, more distinction from fin 36 and base 38 is created, forming a sharper fold line 35.

From foot 116, partially folded bag 10 moves transversely to a second portion of creaser mechanism 114. During this process to the second portion, fingers 110, 112 are removed from fin 36. The second portion of creaser mechanism 114, illustrated in FIG. 5, as sharp creaser mechanism 117, includes various devices to form a sharp crease between fin 36 and base 38. Shown in FIG. 5 are first and second creasing rollers 118 and first and second creasing wheels 120. Rollers 118 have a wide, flat area that further applies pressure to and presses base 38 of partially folded bag 10. A pressure plate 119 can be included to provide further pressure on base 38. Rollers 118 may apply pressure directly to base 38, or to plate 119, which in turn transfers the pressure to base 38. Wheels 120 have a thin area, such as a peripheral edge, that forms a sharp crease or fold between fin 36 and base 38.

The resulting bases 38, one on each side of fin 36, include an angled edge 42 at each side 20, 22 of partially folded bag 10. Edges 42 meet at peak 40 at fin 36. The portion of base 38 defined by angled edges 42 and extending past sides 20, 22 forms a flap 44, which has fin 36 bisecting it. Each side 20, 22 of partially folded bag 10 has a flap 44. It is this flap 44 what will provide a seal area that is later folded and sealed to base 38.

Figure 6:
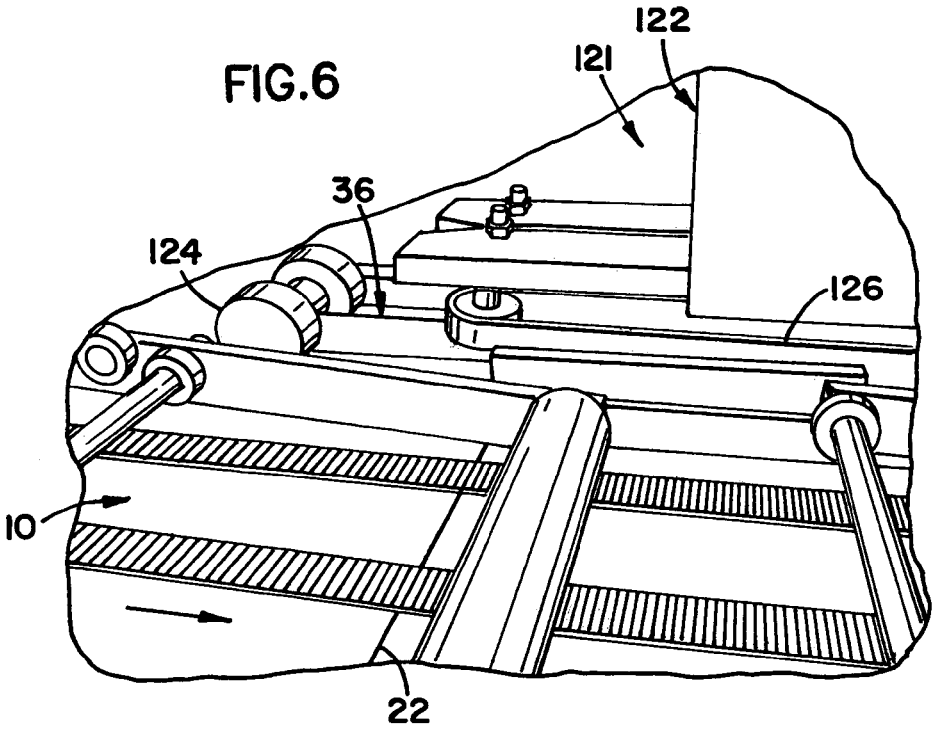
FIG. 6 is a perspective end view, from the opposite side of FIGS. 2, 3 and 4, of a fifth step in the method of the present invention, with the package blank at a third process station.

From creasing mechanism 114, partially folded bag 10, having a sharp fold line 35 between fin 36 and base 38, progresses to a third station to seal edge 13 to edge 15 in order to form a permanent seam at fin 36. Referring to FIG. 6, partially folded bag 10, progressing as indicated transversely from left to right of the drawing, nears a sealing station 121. Preferably, sealing station 121 includes a sealing mechanism that provides the desired seal. In the embodiment illustrated, sealing station 121 includes a continuous sealer, such as a rotary band sealer 122. Various movement devices, such as feed rollers 124 and conveyor band 126, feed partially folded bag 10 into rotary band sealer 122. An example of a suitable rotary band sealer 122 is Model AN ST225 available from Steeltec. Fin 36 is sealed by sealing station 121. Particularly, a seal is formed by rotary band sealer 122 between the material present between edge 13 to fold line 35 and edge 15 to fold line 35.

Figure 7:
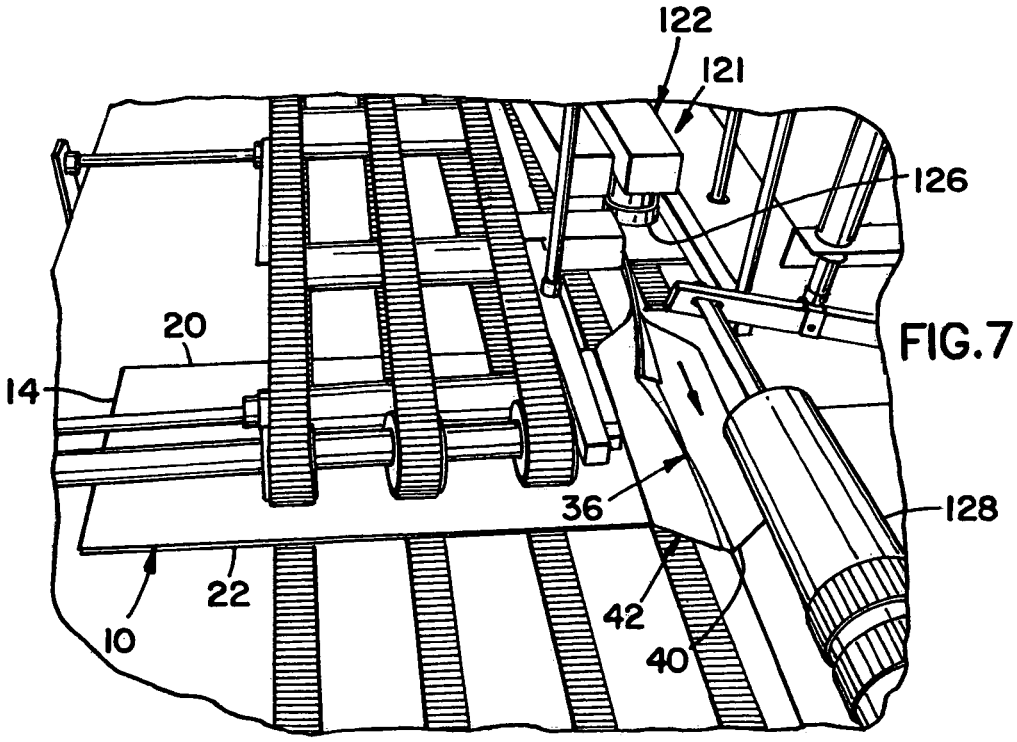
FIG. 7 is a perspective side view, of the fifth step, with the package blank exiting the third process station.
Figure 8:
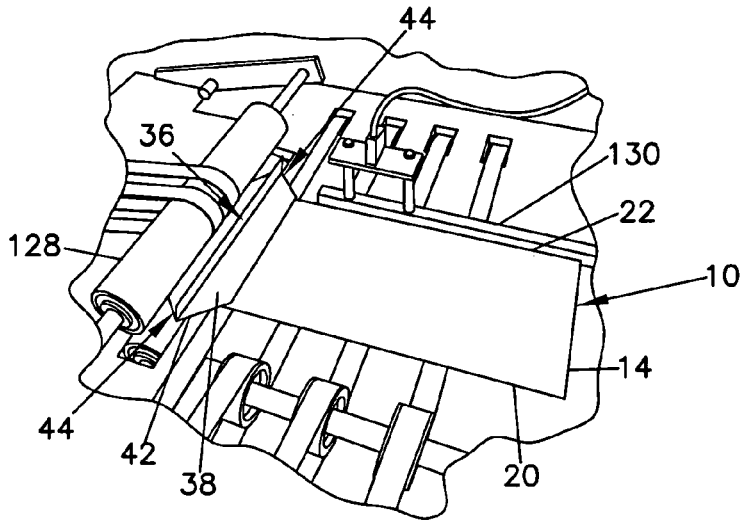
FIG. 8 is a perspective top side view, of a holding step for the package blank, between the third process station and a fourth process station.

Partially folded bag 10, with sealed fin 36, exits sealing station 121 (e.g., rotary band sealer 122) in FIG. 7. Partially folded bag 10 progresses, still transversely, to a temporary or holding station at roller 128. Partially folded bag 10 is conveyed adjacent to roller 128 until partially folded bag 10 contacts stop 130, where partially folded bag 10 awaits entry into the next station. In FIG. 8, side edge 22 of partially folded bag 10 is illustrated against stop 130. When pressure is sensed by stop 130 (e.g., when the presence of partially folded bag 10 against stop 130 is sensed) and a sufficient time interval has passed since the previous partially folded bag 10, partially folded bag 10 progress under roller 128 at a bottom closing station which folds flaps 44. When progressing under roller 128 to and through the bottom closing station, partially folded bag 10 moves longitudinally.

Figure 9:
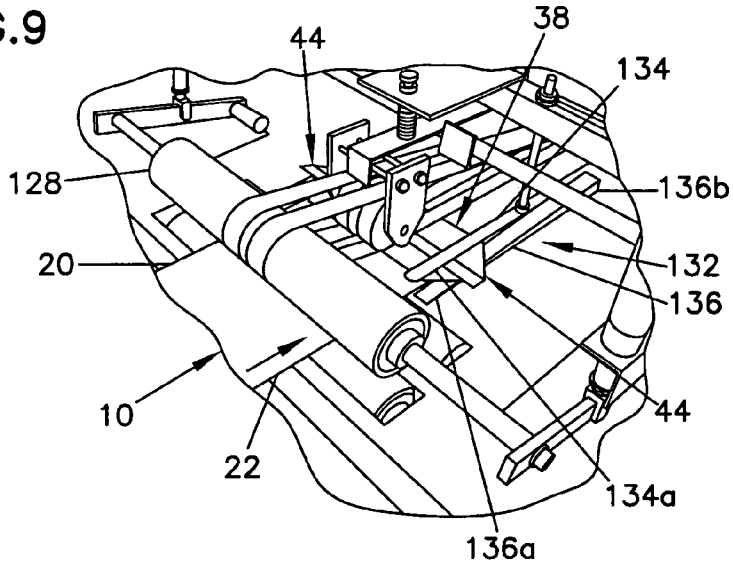
FIG. 9 is a perspective top side view, from the opposite side of FIG. 8, of a sixth step in the method of the present invention, with the package blank entering the fourth process station.
Figure 10:
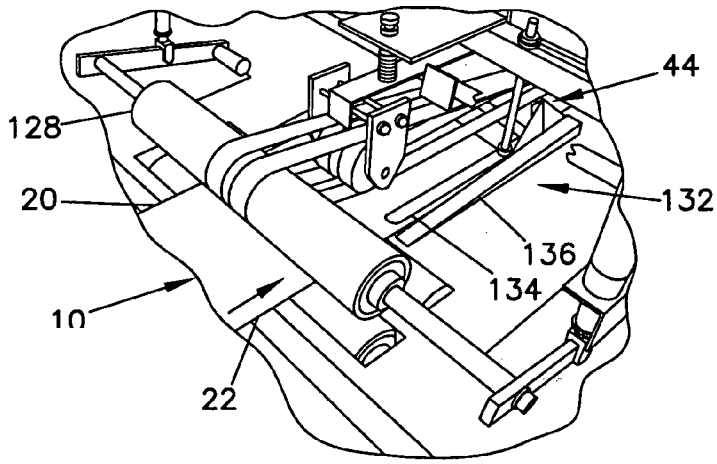
FIG. 10 is the same view as FIG. 9, with the package blank within the fourth process station.

FIG. 9 illustrates partially folded bag 10 progressing under roller 128 to closing mechanism 132 at the bottom closing station; FIG. 10 illustrates partially folded bag 10 farther under roller 128 and being acted on by closing mechanism 132. Closing mechanism 132 includes a pair of inner bars 134 and a pair of outer bars 136, one of each of bars 134, 136 on each side of partially folded bag 10. Bars 134, 136 are positioned so that inner bar 134 is positioned closer to a centerline of partially folded bag 10 than outer bars 136 are. Inner bar 134 has a first end 134*a* and an opposite second end 134*b*.

Partially folded bag 10 progresses between bars 134, 136, specifically, so that flap 44 passes over outer bar 136 and base 38, and possibly a portion of flap 44, pass under inner bar 134. Inner bar 134 is configured so that the bottom surface of bar 134 (e.g., the surface against partially folded bag 10) lowers as it progresses from first end 134*a* to second end 134*b*. Similarly, outer bar 136 has a first end 136*a* and an opposite second end 136*b*. However, outer bar 136 is configured so that the top surface of bar 136 (e.g., the surface against partially folded bag 10) raises as it progresses from first end 136*a* to second end 136*b*. Either or both bars 134, 136 may be bars having a generally rectangular shaped, or, either or both bars 134, 136 may have a tapered, beveled, or wedge shape. In the embodiment illustrated in FIGS. 9 and 10, inner bar 134 is a plate and outer bar 136 is a tapered or wedge bar, having a greater thickness at second end 136*b* than at first end 136*a*.

As partially folded bag 10 progresses longitudinally, flap 44, one on each side 20, 22 of partially folded bag 10, enters between upper bevel bar 134 and outer bar 136. As partially folded bag 10 further progresses between bars 134, 136, fin 36 is folded by inner bar 134 and outer bar 136 at flaps 44. The upward tapered or beveled surface on outer bar 136 folds flap 44 upward, while inner bar 134 holds fin 36 and the rest of base 38 down. A crease results between flap 44 and the rest of base 38.

Figure 11:
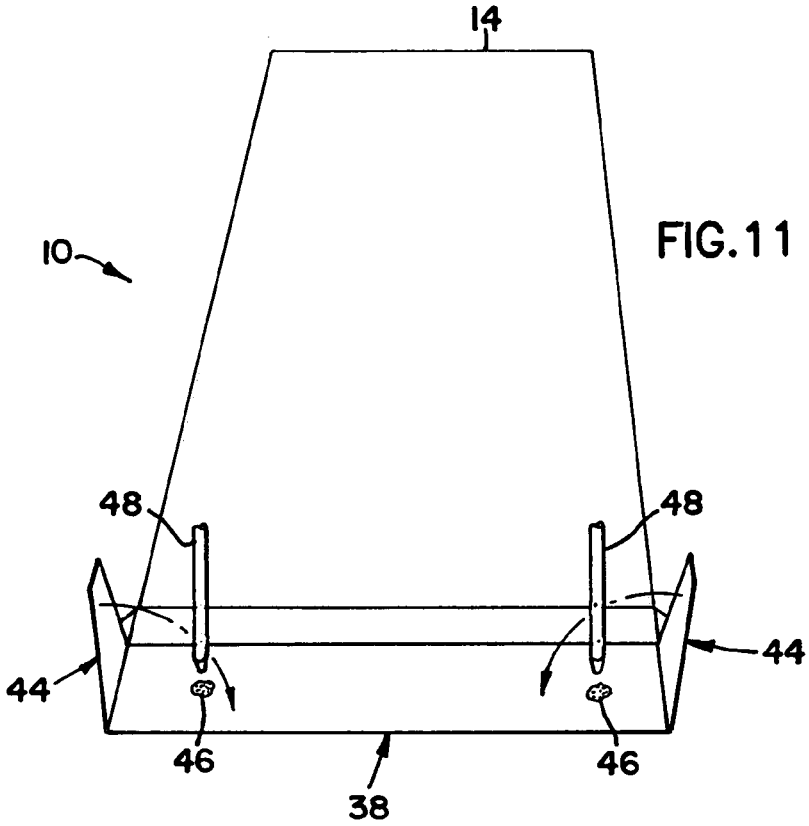
FIG. 11 is a schematic depiction of two steps which occur to the package blank at the fourth process station.

Additionally at this bottom closing station, a sealant, such as hot melt adhesive, is applied to base 38 prior to flaps 44 being folded down against base 38. Adhesive 46 is illustrated being applied to base 38 in FIG. 11 by applicators 48. After adhesive 46 is applied, flaps 44 are folded against base 38, as illustrated in FIG. 11, and preferably tacked with pressure. Although not illustrated, various devices, including rollers, bars, arms, etc. can be used to fold flaps 44 against adhesive 46. Rollers can be used to apply pressure to flaps 44.

Figure 12:
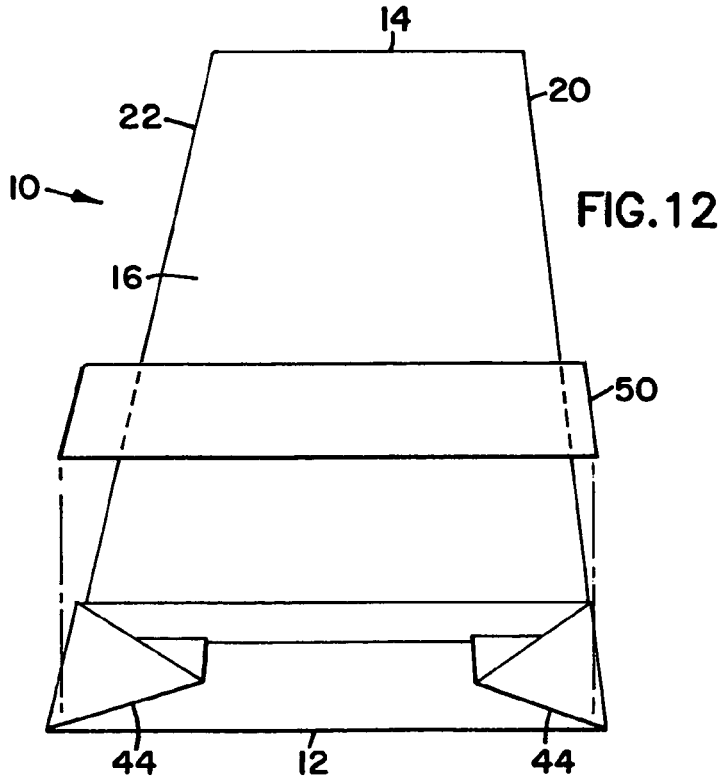
FIG. 12 is a schematic depiction of a final step which occurs to the package blank to form the completed package.
Figure 13:
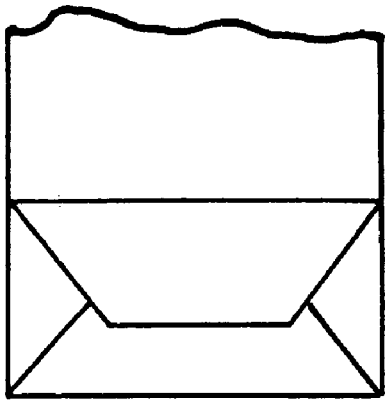
FIG.13 (PRIOR ART)
FIG. 13 is a schematic depiction of the bottom of a conventional paper flat bottom bag.
Figure 14:
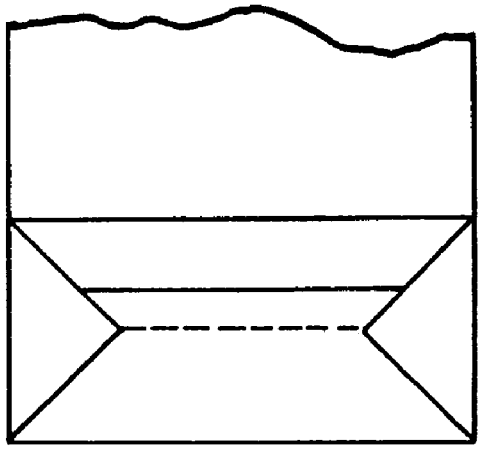
FIG.14 (PRIOR ART)
FIG. 14 is a schematic depiction of the bottom of a paper flat bottom bag made by the process of U.S. Pat. No. 3,266,387 to Finke et al.

A label 50 can be applied to partially folded bag 10 after flaps 44 have been sealed to base 38, as illustrated in FIG. 12. Label 50 can be applied in the same process as the folding of partially folded bag 10, described above, or can be applied in a different process removed from the one described above. Still further, label 50 could be applied manually, although this is not preferred.

The resulting finished package has an interior that is defined by a sleeve having a mouth at mouth end 14 for providing access to the interior and a base at end 12 opposite the mouth. The sleeve is defined by side edges 20, 22 and face panel 16 and an opposite face panel (not illustrated). Label 50, if present, would cover flaps 44.

The above specification, examples and data provide a complete description of the manufacture and use of the structure of the invention. Since many embodiments of the invention can be made without departing from the spirit and scope of the invention, the invention resides in the claims hereinafter appended.

What is claimed:

1. A method of folding a bag, the method comprising:

(a) providing an unfinished flat bottom bag having a sleeve defining a longitudinal direction and a transverse direction, the bag comprising a mouth end and a bottom end and longitudinal gussets extending from the mouth end to the bottom end, the bottom end having an unfinished base portion;

(b) opening the unfinished base portion and extending the gussets transversely while the unfinished base portion is stationary;

(c) forming a crease between an end-most portion of the bottom end while the unfinished base portion is moving continuously in the transverse direction;

(d) forming a fin extending transversely across the unfinished base portion by sealing the end-most portion of the bottom end while the unfinished base portion and the fin are being moved continuously in the transverse direction; and (e) folding a first end and a second end of the fin against the unfinished base portion while the unfinished base portion is moved continuously in the longitudinal direction to form a base.

2. The method according to claim 1, wherein the step of opening the unfinished base portion and extending the gussets transversely comprises:

(a) lifting a flap of the unfinished base portion prior to opening the unfinished base portion.

3. The method according to claim 1, wherein the step of opening the unfinished base portion and extending the gussets transversely comprises:

(a) inserting an opening mechanism into the unfinished based portion between two sides of an end-most portion of the bottom end;

(b) moving the opening mechanism transversely to pull taught the end-most portion of the bottom end.

4. The method according to claim 1, wherein the step of sealing the end-most portion comprises:

(a) moving the end-most portion of the bottom end through a continuous sealer.

5. The method according to claim 4, wherein the step of moving the end-most portion of the bottom end through a continuous sealer comprises:

(a) moving the end-most portion of the bottom end through a rotary sealer.

6. The method according to claim 1, wherein:

(a) the step of forming a fin extending transversely across the unfinished base portion comprises moving the unfinished bag in the transverse direction; and (d) the step of folding a first end and a second end of the fin against the unfinished base portion to form a base comprises moving the unfinished bag in the longitudinal direction during the step of folding.

7. The method according to claim 6, wherein the step of folding a first end and a second end of the fin against the unfinished base portion to form a base comprises:

(a) folding the first end and the second end by passing each of the ends under an inner bar and over an outer bar, the outer bars having a greater transverse distance therebetween than the inner bars; and (b) lifting each of the ends with the outer bars to form a fold between the inner bars and the outer bars.

8. The method according to claim 7, wherein the step of lifting each of the ends with the outer bars comprises:

(a) providing outer bars having an angled top surface extending from a first end of the bars to a second end.

9. The method according to claim 1, further comprising:

(a) sealing the first end and the second end of the fin against the unfinished base portion to form the base.

10. The method according to claim 1, further comprising:

(a) attaching a label over the base.

11. The method according to claim 1, further comprising:

(a) obtaining at least 20 sealed bags per minute by the method.

12. The method according to claim 11, wherein the step of obtaining at least 20 sealed bags from the method comprises:

(a) obtaining at least 40 bags per minutes by the method.

13. A method of folding at least 20 bags/minute, the method comprising:

(a) providing an unfinished flat bottom bag having a sleeve defining a longitudinal direction and a transverse direction, the bag comprising a mouth end and a bottom end and longitudinal gussets extending from the mouth end to the bottom end, the bottom end having an unfinished base portion;

(b) opening the unfinished base portion and expanding the gussets while the unfinished base portion is stationary;

(c) forming a crease between an end-most portion of the bottom end while the unfinished portion is moving continuously in the transverse direction;

(d) forming a fin across the unfinished base portion by sealing the end-most portion of the bottom end while the unfinished base portion and the fin are being moved continuously in the transverse direction; and (e) folding a first end and a second end of the fin against the unfinished base portion while the unfinished base portion is moving continuously in the longitudinal direction to form a base.

14. The method according to claim 13, wherein the method comprises folding at least 40 bags/minute.

15. The method according to claim 13, wherein the step of sealing the end-most portion comprises:

(a) moving the end-most portion of the bottom end through a continuous sealer.

16. The method according to claim 15, wherein the step of moving the end-most portion of the bottom end through a continuous sealer comprises:

(a) moving the end-most portion of the bottom end through a rotary sealer.

* * * * *